US005249779A

United States Patent [19]

LaBate, II

[11] Patent Number: 5,249,779

[45] Date of Patent: Oct. 5, 1993

[54] MODIFIED MANIFOLD ASSEMBLY FOR DIRECTIONAL GAS DISTRIBUTION DEVICE

[76] Inventor: Michael D. LaBate, II, 110 N. Market St., East Palestine, Ohio 44413

[21] Appl. No.: 911,725

[22] Filed: Jul. 10, 1992

[51] Int. Cl.[5] ..... C21C 5/48

[52] U.S. Cl. ..... 266/224; 266/265

[58] Field of Search ..... 266/220, 270, 266, 265, 266/224

[56] References Cited

U.S. PATENT DOCUMENTS

| | | | |
|---|---|---|---|
| 4,396,179 | 8/1983 | LaBate | 266/220 |
| 4,483,520 | 11/1984 | LaBate | 266/220 |
| 4,538,795 | 9/1985 | LaBate | 266/220 |
| 4,632,367 | 12/1986 | LaBate | 266/220 |
| 4,687,184 | 8/1987 | LaBate et al. | 266/270 |
| 4,725,047 | 2/1988 | LaBate | 266/270 |
| 4,840,356 | 6/1989 | LaBate | 266/265 |
| 5,152,954 | 10/1992 | Helmut | 266/270 |

*Primary Examiner*—Melvyn J. Andrews
*Attorney, Agent, or Firm*—Harpman & Harpman

[57] ABSTRACT

A modified manifold assembly for pocket blocks having fusto conical openings therethrough. The manifold assembly defines an interconnecting passageway from a central gas input supply to multiple formation of gas conveying passageways within the pocket block. The modified manifold assembly positions and holds synthetic resin nets which form the interconnecting passageways during use.

4 Claims, 2 Drawing Sheets

MODIFIED MANIFOLD ASSEMBLY FOR DIRECTIONAL GAS DISTRIBUTION DEVICE

BACKGROUND OF THE INVENTION

1. Technical Field

This invention relates to devices for insufflating gas into a massive molten metal in a vessel.

2. Description of Prior Art

Prior art devices of this type have utilized fusto conical pocket blocks having multiple openings therethrough to supply stirring gas under pressure into a mass of molten metal. See for example applicant's copending applications Ser. No. 07/649,551 and Ser. No. 07/717,351, and U.S. Pat. Nos. 4,396,179, 448,520, 4,538,795, 4,632,367, 4,687,184, 4,725,047 and 4,840,356.

LaBate company U.S. Pat. Nos. 4,836,433 and 4,858,894 show pocket blocks in which gas conducting manifold can be seen interconnected to gas conducting passageways which are directly formed and applicant's pending applications disclose formation of interconnecting passageways by the insertion of a synthetic resin filament net within the pocket block during casting.

The present invention is directed to the formation of the manifold within the pocket block with support and positioning of the synthetic resin net within the manifold and block during the molding of the pocket block.

SUMMARY OF THE INVENTION

A modified manifold mounting assembly for a pocket block having the novel formation of a gas supplying manifold and support of gas forming passageways by synthetic resin filament network embedded within the refractory of the pocket block as it is being formed. The modified manifold mounting assembly establishes communication with the network of interconnecting flexible synthetic resin filaments. The modified manifold mounting assembly securely holds and positions the synthetic resin filaments within a mold form in which the pocket block is cast.

DESCRIPTION OF THE PREFERRED EMBODIMENT

Figure 4:
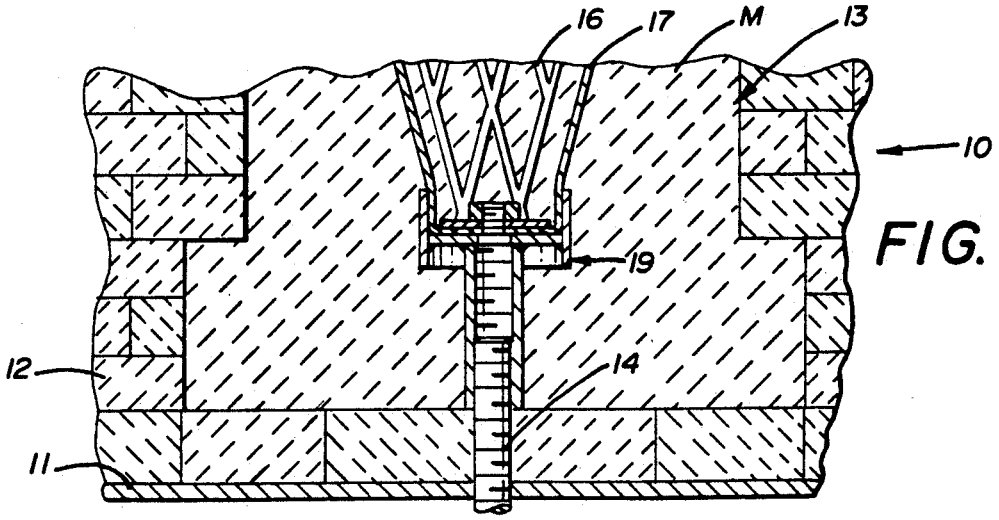
FIG. 4 is a cross-sectional view of the modified manifold mounting assembly in a cast pocket block within a molten metal vessel.

By referring to FIG. 4 of the drawings, a portion of a molten metal vessel 10 can be seen having a bottom 11 together with a refractory lining units 12 and a pocket block 13 positioned therein. A gas supply pipe 14 extends upwardly through an opening in the vessel 10 registering with a supply opening in the pocket block 13. The pocket block 13 is formed of a refractory material M cast within a mold form 15 shown in broken lines in FIG. 1 of the drawings. A manifold opening is formed within the pocket block 13. Spaced above said manifold opening and extending upwardly to an upper surface (not shown) of the pocket block 13 there are a plurality of small interconnected passageways 16 and preferably one or more individual upwardly extending passageways 17, all of which terminate above the manifold opening.

The plurality of small interconnecting passageways 16 are formed by embedding a desirably shaped synthetic resin network of flexible filaments 18 which are best seen in FIGS. 1–4 of the drawings within the refactory material M.

The shape of the synthetic resin filament network being exaggerated as to the thickness of the synthetic resin filaments 18.

Figure 1:
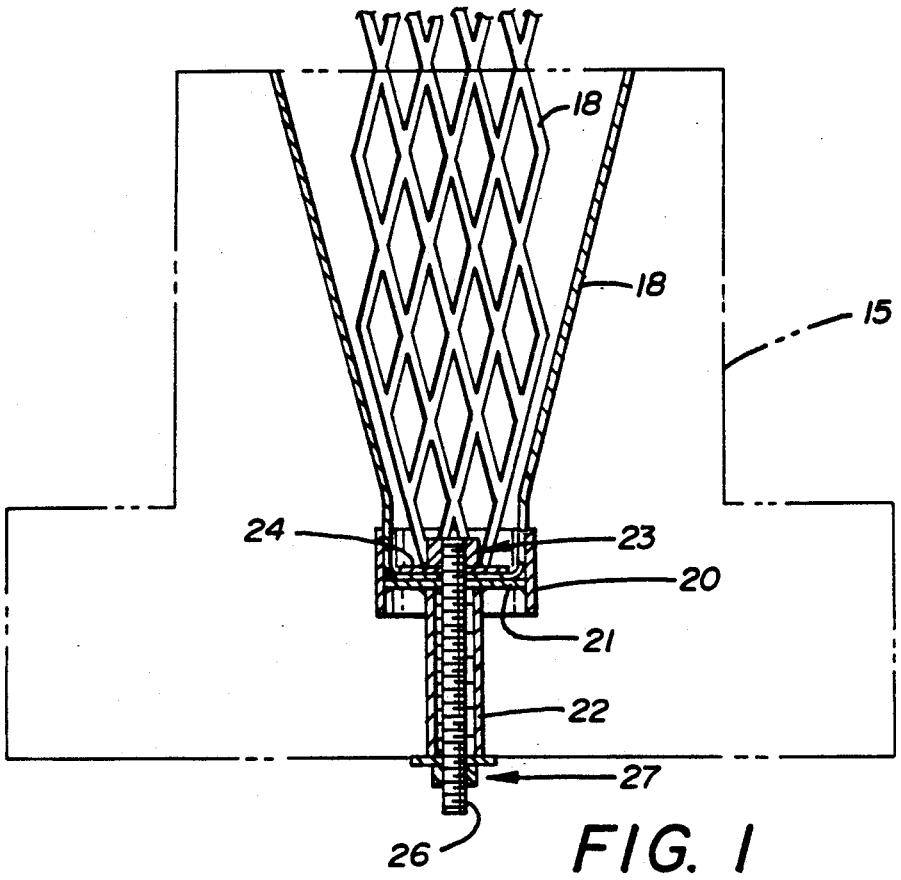
FIG. 1 is a vertical section through the modified manifold mounting assembly with a mold representation shown in broken lines.
Figure 2:
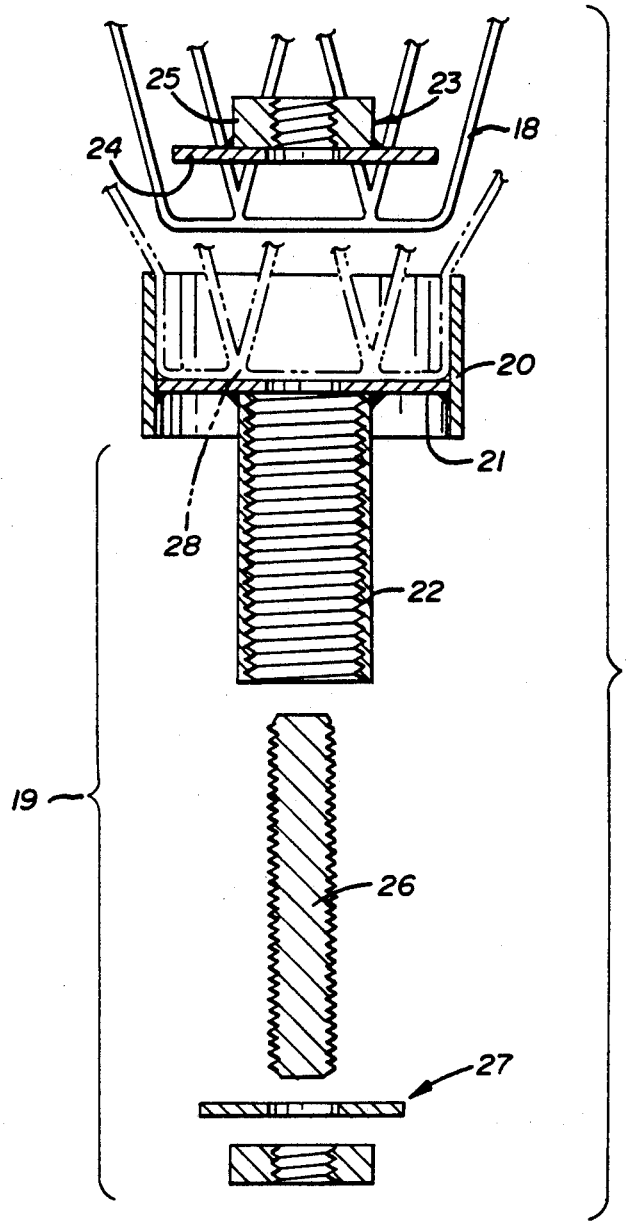
FIG. 2 is an exploded cross-sectional assembly view of the modified manifold mounting assembly.

Referring to FIGS. 1 and 2 of the drawings, a manifold assembly 19 can be seen which forms the manifold opening at 19A and is embedded within the pocket block 13 during casting. The manifold assembly 19 has an outer support sleeve 20 with an apertured partition 21 secured within. An internally threaded gas supply fitting 22 extends from and is secured centrally to said apertured partition 21 best seen in FIG. 2 of the drawings. A filament position and mounting fitting 23 is comprised of an apertured washer 24 with an attached threaded nut 25.

In use, the net at the synthetic resin filament 18 is positioned between the respective apertured partition 21 and the filament mounting fitting 23. A connecting rod 26 extends through said gas supply fitting 22 threadably engaging the nut 22 of the filament positioning and mounting fitting 23.

Figure 3:
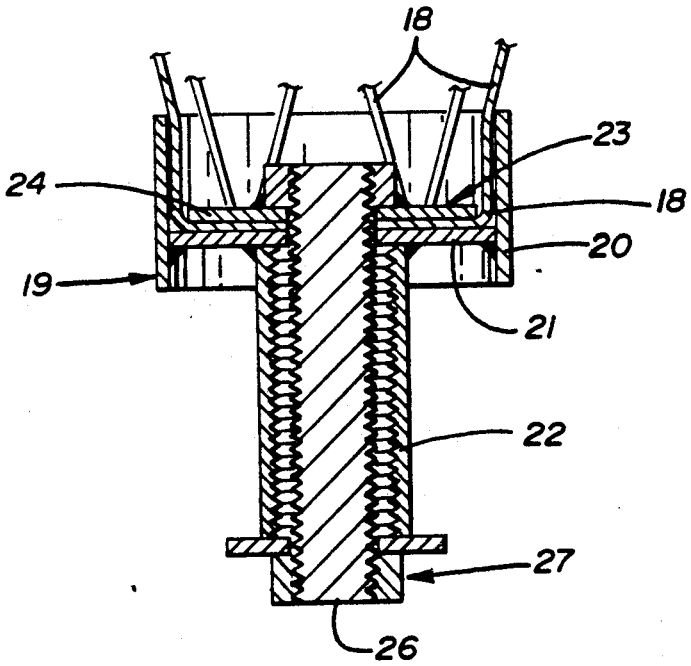
FIG. 3 is an enlarged cross-sectional view of the modified manifold assembly during casting of the pocket block.

A second washer and nut assembly 27 is positioned on the free end of said connecting rod 26 securing the filament mounting fitting 23 against the filament 18 and in spaced relation to said, apertured partition 21 thus holding the filament 18 between said mounting fitting 23 and said apertured partition 21 as seen in FIGS. 1–3 of the drawings.

The completed manifold assembly 19 with attached filaments 18 is positioned within a mold outline representation 15 for casting the refractory M within to form the pocket block 13 as seen in FIGS. 1 and 2 of the drawings with the desired shape, network of interengaging synthetic resin filaments and manifold opening completely embedded within the refractory M of which the pocket block 13 is formed.

The connecting rod 26 with associated secondary washer and nut assembly 27 is removed from the mold representation 15 after it has set leaving the completed manifold opening within the pocket block 13 as seen in FIG. 4 of the drawings, in which said supply pipe 14 has been threadably inserted into the completed pocket block via the gas supply fitting 22 hereinbefore described and as best seen in FIG. 4 of the drawings.

It will occur to those skilled in the art that the manifold opening formed when the manifold assembly 19 within the completed pocket block 13 in use will be cross-sectionally uniform as seen in broken lines in FIG. 2 of the drawings at 28 once the synthetic resin filaments 18 have melted and are consumed by the heat of the molten mass (not shown) in the vessel 10 during use.

It will occur to those skilled in the art that the size of the manifold assembly 19 and the filaments 18 can be varied to produce the desired small or very small passageways 16 and 17 and associated manifold cross-section area 28 seen in FIG. 4 of the drawings.

It is clear from the description above that by use of the modified manifold assembly that a manifold opening can be formed which will interconnect between the gas supply fitting 22 and the interconnected passageways which will be formed by the embedded synthetic resin filaments 18 and that the manifold thus formed will provide an even continuous supply of stirring gas through the network of channels formed by the embedded filaments.

It will thus be seen that a new and novel modified manifold assembly for use in a pocket block formation for directing gas into a molten metal mass has been described and that it will be apparent to those skilled in the art that various changes and modifications may be made therein without departing from the spirit of the invention.

Therefore I claim:

1. A manifold assembly for a pocket block that is used to introduce gas into a mass of molten metal and a vessel having a refractory lining, said pocket block formed of a cast refractory material, said manifold assembly comprising a support sleeve, an apertured partition secured within said support sleeve, a gas supply fitting extending from said sleeve, a filament positioning and mounting fitting adjacent said gas supply fitting, means for securing said filament positioning and mounting fitting in spaced relation to said apertured partition, a synthetic resin filament net held between said filament positioning and mounting fitting and said apertured partition, said synthetic resin filament net extending upwardly embedded within said cast refractory material of said pocket block.

2. The manifold assembly for a pocket block of claim 1 wherein said gas supply fitting is centered on said apertured partition opposite said filament positioning and mounting fitting.

3. The manifold assembly for a pocket block of claim 1 wherein said means for securing said filament positioning and mounting fitting in spaced relation to said apertured partition comprises a connecting rod and a washer and nut assembly, said connecting rod extending through said gas supply fitting and threadably engaged within said filament engagement fitting and said washer and nut assembly respectively.

4. The manifold assembly for a pocket block of claim 1 wherein said synthetic resin filament net defines an interconnected passageway between said gas supply fitting and said support sleeve and defines a manifold opening within said pocket block of a uniform cross-sectional configuration.

* * * * *